US007850168B2

(12) United States Patent
Shinkawa et al.

(10) Patent No.: US 7,850,168 B2
(45) Date of Patent: Dec. 14, 2010

(54) RECORDING MEDIUM DELIVERY MECHANISM AND IMAGE FORMING DEVICE HAVING THE SAME

(75) Inventors: Tatsuya Shinkawa, Nara (JP); Shinichi Azumi, Nara (JP); Yuhi Akagawa, Kyoto (JP); Nobuyuki Kimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1062 days.

(21) Appl. No.: 10/551,651

(22) PCT Filed: Apr. 7, 2004

(86) PCT No.: PCT/JP2004/005047

§ 371 (c)(1),
(2), (4) Date: Sep. 29, 2005

(87) PCT Pub. No.: WO2004/089795

PCT Pub. Date: Oct. 21, 2004

(65) Prior Publication Data

US 2006/0232793 A1 Oct. 19, 2006

(30) Foreign Application Priority Data

Apr. 9, 2003 (JP) ..... 2003-105431

(51) Int. Cl.
*B65H 31/20* (2006.01)

(52) U.S. Cl. ..... 271/223; 271/224; 271/220

(58) Field of Classification Search ..... 271/220, 271/223, 224

See application file for complete search history.

(56) References Cited

U.S. PATENT DOCUMENTS

| | | | | |
|---|---|---|---|---|
| 4,838,534 | A * | 6/1989 | Ishikawa et al. | 271/10.03 |
| 4,847,632 | A * | 7/1989 | Norris | 346/134 |
| 4,985,714 | A * | 1/1991 | Norris | 221/195 |
| 5,743,518 | A * | 4/1998 | Takashimizu et al. | 271/4.1 |
| 5,897,113 | A * | 4/1999 | Kondo et al. | 271/213 |
| 5,913,095 | A * | 6/1999 | Takashima et al. | 399/125 |
| 5,974,283 | A * | 10/1999 | Cho | 399/75 |
| 6,237,485 | B1 * | 5/2001 | Fukai | 101/118 |
| 6,522,860 | B2 * | 2/2003 | Nose et al. | 399/374 |

FOREIGN PATENT DOCUMENTS

JP 6-115794 4/1994

(Continued)

OTHER PUBLICATIONS

International Search Report for PCT/JP04/05047 dated May 25, 2004.

*Primary Examiner*—Patrick Mackey
*Assistant Examiner*—Ernesto Suarez
(74) *Attorney, Agent, or Firm*—Nixon & Vanderhye P.C.

(57) ABSTRACT

A recording medium discharge mechanism is provided with a side wall member capable of changing position between an upright state in which small size sheets are caught when small size sheets are discharged and a laid flat state in which a placement surface of a discharge space is extended for placement of large size sheets when large size sheets are discharged by a discharge mechanism having the discharge space, whose downstream side in a paper discharge direction has been opened. In the upright state, the side wall member does not protrude laterally from an apparatus. Furthermore, in the laid flat state, large size sheets can be placed.

6 Claims, 5 Drawing Sheets

FOREIGN PATENT DOCUMENTS

| | | | | |
|---|---|---|---|---|
| JP | 08-339107 | | | 12/1995 |
| JP | 9-6075 | | | 1/1997 |
| JP | 09194107 | A | * | 7/1997 |
| JP | 2000-44107 | | | 2/2000 |
| JP | 2001-302070 | | | 10/2001 |
| JP | 2003002508 | A | * | 1/2003 |
| JP | 2003-118918 | | | 4/2003 |

* cited by examiner

RECORDING MEDIUM DELIVERY MECHANISM AND IMAGE FORMING DEVICE HAVING THE SAME

This application is the US national phase of international application PCT/JP2004/005047 filed 7 Apr. 2004, which designated the U.S. and claims priority to JP 2003-105431 filed 9 Apr. 2003, the entire contents of each of which are hereby incorporated by reference.

TECHNICAL FIELD

The disclosed technology relates to recording medium discharge mechanisms that are installed in image forming apparatuses such as copying machines, printers, and facsimile machines and to image forming apparatuses provided with such recording medium discharge mechanisms. In particular, the disclosed technology relates to internal discharge-type recording medium discharge mechanisms in which the discharge portion for the recording media is arranged in a substantially central portion in the vertical direction of the apparatus.

BACKGROUND ART

Conventionally, it has been desired to reduce the installation space of image forming apparatuses such as copying machines, printers, and facsimile machines, as well as compound machines that are provided with a plurality of these functions.

In response to this desire, image forming apparatuses have been developed in which the feeding portion (paper cassette) is arranged in a lower portion and the original capturing portion (scanner portion) is arranged in an upper portion, while the image forming portion (printer portion) and the discharge portion (discharge tray) are provided between the feeding portion and the original capturing portion. That is, with these image forming apparatuses, a reduction in the apparatus installation space is achieved by providing the discharge tray such that it does not protrude laterally from the apparatus. Furthermore, with these image forming apparatuses, the feeding portion, the original capturing portion, and the image-forming portion are arranged in an approximate square-cornered reverse "C" shape when viewed from the front of the apparatus. In this structure, the discharge portion is configured as an empty intermediate space that opens laterally (one side of the square-cornered reverse "C" shape is open), and printed sheets that are discharged to this empty intermediate space are taken out from the front side or a lateral side (the above-mentioned open side).

However, with this type of image forming apparatus, since visibility is poor for the printed sheets that are discharged to the empty intermediate space, it has been a matter of concern that the user forgets to take out printed sheets or leaves some sheets behind.

Techniques are disclosed in JP H06-115794A (hereinafter referred to as patent document 1) and JP H08-339107A (hereinafter referred to as patent document 2) as ways to solve this fault.

First, in patent document 1, a structure is disclosed in which a rotational movement means is provided in a plurality of discharged paper piling means (a unit of discharged paper trays) in order to achieve overall space savings in an apparatus in which the discharge portion does not protrude from the apparatus. In this structure, after discharge of the paper has been completed, the plurality of discharged paper piling means are rotationally moved as a whole in a horizontal direction.

On the other hand, in patent document 2, in order to improve visibility of the printed sheets that are discharged to the discharge portion in an image forming apparatus provided with a so-called internal discharge-type recording medium discharge mechanism in which only the front side of the apparatus is open, a structure is disclosed that aims to improve visibility of printed sheets by arranging an illuminating lamp at an upper portion of an inner side of the discharge portion such that the illuminating lamp is caused to automatically light up when the discharge of a printed sheet is detected.

However, there is a limit to the device miniaturization that can be achieved with either of these patent documents, and both involve increased complication of control operations by a control portion. That is, with these techniques, a space is required for the discharge portion that is substantially equivalent to the size of the maximum length sheet of the plurality of sheet sizes that are used in the apparatus. For example, in an apparatus using an A3 size (297 mm×420 mm) sheet, 420 mm or more is required for the length of the discharge portion and since a size smaller than this size cannot be achieved, it is not possible to achieve further compactness. The reason for this is that when the space of the discharge portion is made smaller than the size of the maximum length sheet, the sheets become folded over (so-called "back bending") inside the discharge portion in these internal discharge-type apparatuses, thus posing the risk of frequent paper jams.

The embodiments of the present invention have been devised in consideration of these issues, and it is an object thereof to provide a recording medium discharge mechanism that is provided with a discharge space into which a recording medium that has undergone image formation is discharged and that is capable of achieving device compactness and control operation simplification, and an image forming apparatus provided with the recording medium discharge mechanism.

SUMMARY

In order to achieve the above-mentioned object, an embodiment of the present invention is provided with a member capable of changing position between an upright state in which small size sheets are caught when small size sheets are discharged and a laid flat state in which a placement surface of a discharge space is extended for placement of large size sheets when large size sheets are discharged by a discharge mechanism having the discharge space whose downstream side in a paper discharge direction has been opened. That is, the upright state contributes to reductions in the installation space of image forming apparatuses by the fact that this member does not protrude laterally from the apparatus, and with the laid flat state it is possible to achieve placement of large size sheets while avoiding paper bending and paper jams inside the discharge space.

Specifically, a recording medium discharge mechanism is provided with a discharge space that is positioned between an original capturing portion arranged in a device upper portion and a feeding portion arranged in a device lower portion and that opens laterally to a downstream side in a recording medium discharge direction. In this recording medium discharge mechanism, a side wall member is arranged at an open portion of the downstream side in the recording medium discharge direction. Also, the side wall member is configured to be capable of moving between an upright state that closes the open portion and a laid flat state in which a placement surface for placing a discharged recording medium is extended toward the downstream side in the recording medium discharge direction. It should be noted that "placement surface for placing a discharged recording medium" refers to a surface that spans from the recording medium placement surface, which is the bottom surface of the above-mentioned discharge space, to an upper surface of the side wall member in the laid flat state (a surface substantially linked to the above-mentioned recording medium placement surface).

With this specified item, the side wall member becomes upright and closes the open portion when the discharge direction length of the recording medium to be used in image formation is the same length or shorter than the bottom surface of the discharge space for example. This enables the recording medium that is discharged to the discharge space to be caught by the side wall member even when the recording medium is discharged at a comparatively high speed, and the recording medium does not drop from the discharge space. On the other hand, when the discharge direction length of the recording medium used in image formation is longer than the recording medium discharge direction length of the bottom surface of the discharge space, the side wall member becomes laid flat such that the above-described open portion is opened and the placement surface for placing the recording media that are discharged extends toward the downstream side of the recording medium discharge direction. This enables lengthy recording media to be placed extending from the bottom surface of the discharge space over the upper surface of the side wall member, which makes it possible to avoid paper bending and paper jams inside the discharge space and prevents dropping of the recording media from the discharge space. By providing the side wall member that is capable of moving between the upright state and the laid flat state as described above, the position of the edge of one end of the image forming apparatus may be set at the position of the side wall member in the upright state, and large size sheets can be held without dropping even without extending this laterally from the position of the side wall member. Thus, it is possible to achieve compactness in the installation space of the apparatus. Furthermore, it is sufficient to provide only a mechanism for changing the position of the side wall member, and it is unnecessary to provide a mechanism for horizontally rotating the discharged paper collection means as is done conventionally or to carry out ON/OFF control of a lighting lamp, and therefore control operation can be simplified.

Specific dimensions of the above-mentioned discharge space are given below. Namely, the recording medium placement surface, which is a bottom surface of the discharge space, is set such that a discharge direction length thereof is shorter than a discharge direction length of a largest recording medium among a plurality of types of recording media used in an image forming apparatus.

With this specified item, at least when carrying out image formation on a recording medium having the maximum discharge direction length, the side wall member becomes laid flat such that the above-described open portion is opened and the placement surface for placing the recording media is extended toward the downstream side of the recording medium discharge direction. That is, it becomes possible to provide a discharge space in an image forming apparatus in which the discharge direction length is shorter than the maximum discharge direction length of the recording medium, thereby realizing reductions in installation space.

Furthermore, the following is offered as a structure by which switching between the upright state and the laid flat state is achieved for the side wall member. Namely, the side wall member is configured such that when a recording medium has been discharged to the discharge space in the upright state in which the open portion is closed by the side wall member, the upright state changes to the laid flat state only upon receiving an external force from the recording medium.

For example, a configuration is possible in which a biasing means (a coil spring or the like) is provided that applies a biasing force on the side wall member to the upright state side, and by setting this biasing force low, the side wall member can be made to easily go into the laid flat state by the external force received from the recording medium when the recording medium is discharged. Then, due to the biasing force of the biasing means, the side wall member again becomes upright and does not protrude once the recording medium is removed from the discharge space, thus contributing to compactness of the installation space of the apparatus. With this structure, the above-described switching operation can be realized without necessitating a special drive source for switching between the upright state and the laid flat state of the side wall member. It should be noted that the recording medium discharge speed or the recording medium hardness for making the side wall member go into a laid flat state are determined by appropriately setting the biasing force of the above-mentioned biasing means.

Furthermore, the side wall member is configured to go into the laid flat state prior to a discharge operation of a recording medium only when a discharge direction length of the recording medium to undergo image formation in an image-forming portion is longer than a length of a recording medium placement surface of the discharge space. For example, a drive source such as an actuator or a solenoid is provided to cause rotation of the side wall member between the upright state and the laid flat state, and the drive source is driven in accordance to the discharge direction length of the recording medium. This makes it possible to avoid the end of the recording medium that is to be discharged from colliding with the side wall member such that damage or the like to the end of the recording medium can be reliably avoided.

More specific dimensions of these portions can be given in that, when a recording medium discharge direction length of a recording medium placement surface of the discharge space is given as L1, a discharge direction length of a largest recording medium among a plurality of types of recording media used in an image forming apparatus is given as L2, and an extension length dimension toward a downstream side in the recording medium discharge direction of the paper placement surface when the side wall member has been put into the laid flat state is given as L3, the following is true:

$$L3 \leqq L2 - L1. \quad (1).$$

With this specified item, when image formation is carried out on a recording medium of the maximum discharge direction length, the side wall member becomes laid flat, but if the conditions of the above-described relational expression are met, the position of the end portion of the recording medium at this time is a position protruding slightly further than the end position of the side wall member. Thus, a user is able to easily take out the recording medium by gripping the end portion of the discharged recording medium, which enables improved recording medium withdrawal and obviates the side wall member being made larger than necessary.

A material of the side wall member is given specifically as a transparent member or a semitransparent member. For example, the side wall member may be constructed using an acrylic resin panel or the like. With this specified item, outside light passes through the side wall member to illuminate the interior of the discharge space even when the side wall member is in the upright state, which achieves improved visibility for recording media that are discharged to the discharge space even without using a special lighting apparatus and enables prevention of the user forgetting to take out the recording media.

Furthermore, an image forming apparatus provided with an above-described recording medium discharge mechanism, an original capturing portion arranged at an upper portion of the recording medium discharge mechanism, and a feeding portion arranged at a lower portion of the recording medium discharge mechanism is within the scope of the technical idea of the present invention. The image forming apparatus is characterized by a configuration in which a side wall member is provided at an open portion of the downstream side in the recording medium discharge direction of the discharge space that is capable of moving between an upright state and a laid flat state.

DETAILED DESCRIPTION

Hereinafter, one or more embodiments of the present invention will be described with reference to the accompanying drawings. The disclosed embodiment is described regarding a case in which the embodiment is applied to a compound machine provided with a combination of a copying function, a printing function, and a facsimile function.

—Description of the Overall Configuration of the Compound Machine—

Figure 1:
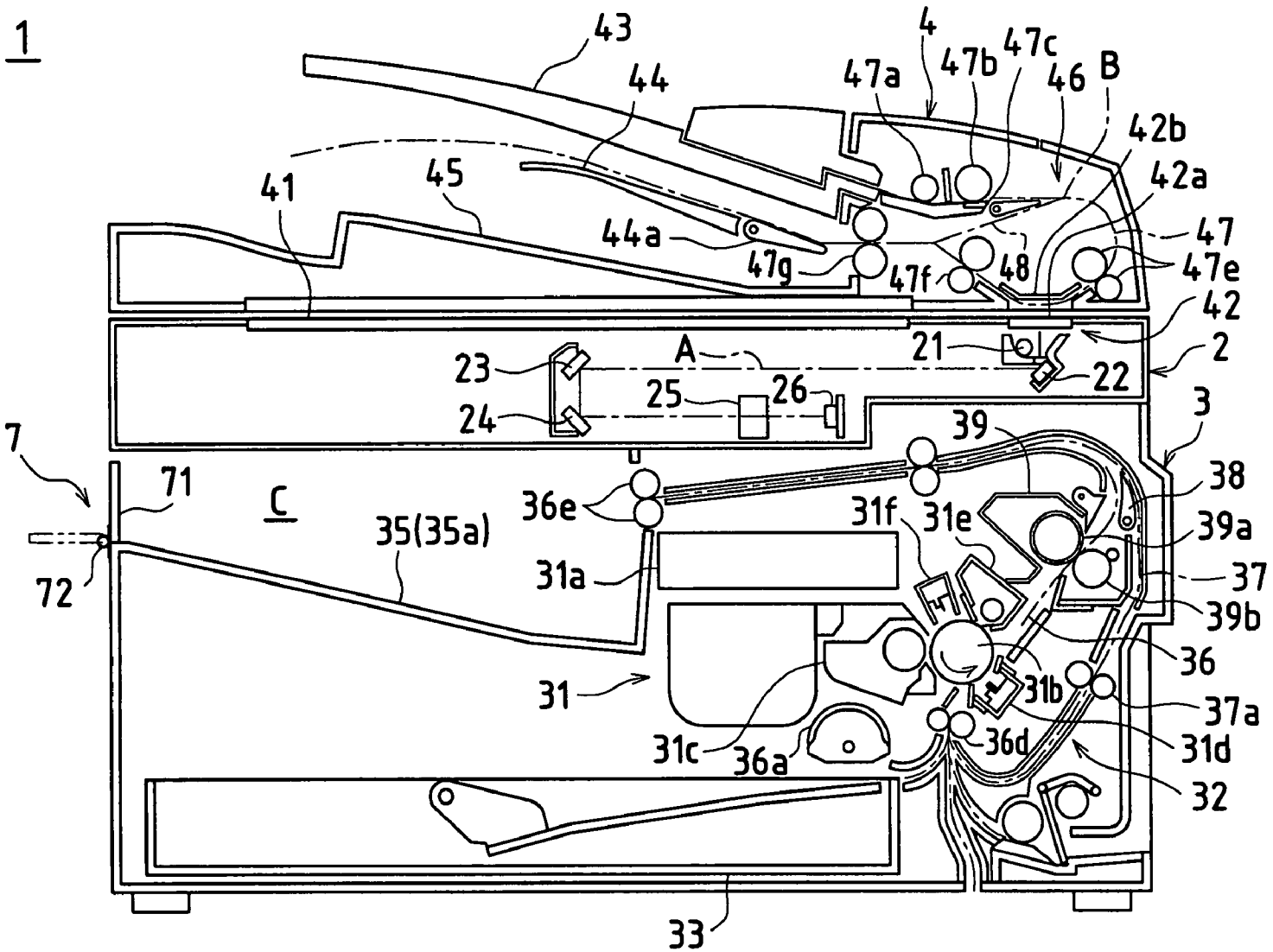
FIG. 1 shows an outline of an internal configuration of a compound machine according to an embodiment of the present invention.

FIG. 1 shows an outline of the internal structure of a compound machine 1 as an image forming apparatus according to the embodiment. As shown in FIG. 1, the compound machine 1 is provided with a scanner portion 2 as an original capturing portion, a printing portion 3 as an image-forming portion, and an automatic original feeding portion 4. The following is a description of the components therein.

The scanner portion 2 is a portion that reads images such as an image of an original placed on an original stage 41 made of a material such as transparent glass and images of originals supplied sheet by sheet by the automatic original feeding portion 4 and generates image data. The scanner portion 2 is provided with an exposure light source 21, a plurality of reflectors 22, 23, and 24, an imaging lens 25, and a CCD (charge coupled device) 26.

The exposure light source 21 irradiates light toward an original placed on the original stage 41 of the automatic original feeding portion 4 or originals transported on the automatic original feeding portion 4. The reflectors 22, 23, and 24 are configured such that, as with the light path shown by the dashed dotted line in FIG. 1, after light reflected once from the original is reflected in a leftward direction in the drawing, it is reflected downwards, then reflected rightwards in the drawing towards the imaging lens 25.

When an original is placed on the original stage 41 as an image reading operation of the original (when used as a "fixed sheet system"), the exposure light source 21 and the reflectors 22, 23, and 24 scan horizontally along the original stage 41 and read an image of the entire original. On the other hand, when reading an original transported on the automatic original feeding portion 4 (when used as a "sheet movement system") the exposure light source 21 and the reflectors 22, 23, and 24 are fixed in the position shown in FIG. 1, and the original capturing portion 42 of the automatic original feeding portion 4, which is to be described later, reads the images while the original passes through.

The light that is reflected by the reflectors 22, 23, and 24 and passes through the imaging lens 25 is guided to a CCD 26, and the reflected light is transformed by the CCD 26 into an electric signal (original image data).

The printing portion 3 is provided with an image-forming system 31 and a paper transport system 32.

The image-forming system 31 is provided with a laser scanning unit 31*a* and a photosensitive drum 31*b* as a drum-type image carrier. Based on original image data converted by the CCD 26, the laser scanning unit 31*a* irradiates a laser light onto a surface of the photosensitive drum 31*b*. The photosensitive drum 31*b* rotates in the direction shown by the arrow in FIG. 1 and an electrostatic latent image is formed on the surface thereof by the irradiation of laser light from the laser scanning unit 31*a*.

Furthermore, in addition to the laser scanning unit 31*a*, a development apparatus (development mechanism) 31*c*, a transfer unit (transfer mechanism) 31*d*, a cleaning apparatus (cleaning mechanism) 31*e*, an unshown charge removal unit, and a charging unit 31*f* are circumferentially arranged in order around the periphery of the photosensitive drum 31*b*. The development apparatus 31*c* uses toner (a substance for developing) to develop the electrostatic latent image formed on the surface of the photosensitive drum 31*b* into a developing image. The transfer unit 31*d* transfers the toner image formed on the surface of the photosensitive drum 31*b* to a sheet for image formation, which is a recording medium. The cleaning apparatus 31*e* removes toner that is residual on the surface of the photosensitive drum 31*b* after toner transfer. The charge removal unit removes electric charges that are residual on the surface of photosensitive drum 31*b*. The charging unit 31*f* charges the surface of the photosensitive drum 31*b* to a predetermined electric potential prior to the forming of the electrostatic latent image.

In this way, when forming an image on the sheet for image formation, the surface of the photosensitive drum 31*b* is charged to a predetermined electric potential by the charging unit 31*f* and the laser scanning unit 31*a* irradiates a laser light onto the surface of the photosensitive drum 31*b* based on the original image data. After this, the development apparatus 31*c* uses toner to develop a visible image on the surface of the photosensitive drum 31*b*, and the toner image is transferred to the sheet for image formation by the transfer unit 31*d*. Further still, after this, toner that is residual on the surface of the photosensitive drum 31*b* is removed by the cleaning apparatus 31*e* and electric charges that are residual on the surface of the photosensitive drum 31*b* are removed by the charge removal unit. This completes one, cycle of an operation of forming an image on a sheet for image formation (a printing operation). By repeating this operation it is possible to carry out continuous image forming with respect to a plurality of sheets for image formation.

On the other hand, the paper transport system 32 transports sheet by sheet sheets for image formation that are stored in a paper cassette 33 as a paper storage portion, for image forming to be carried out by the image-forming system 31 and also discharges sheets for image formation on which an image has been formed to a discharge tray 35 as a discharge portion.

The paper transport system 32 is provided with a main transport path 36 and a reverse transport path 37. One end of the main transport path 36 is positioned in opposition to a discharge side of the paper cassette 33 and another end is in opposition to the discharge tray 35. As for the reverse transport path 37, one end is connected to the main transport path 36 upstream (lower side in the drawing) from the arranged position of the transfer unit 31*d*, and connected to the main transport path 36 downstream (upper side in the drawing) from the arranged position of the transfer unit 31*d*.

A pickup roller 36*a* that is semicircular in profile is arranged at an upstream end of the main transport path 36 (a portion facing a discharge side of the paper cassette 33). The sheets for image formation stored in the paper cassette 33 are able to be intermittently supplied to the main transport path 36 sheet by sheet due to the rotation of the pickup roller 36*a*.

Register rollers 36*d* are arranged upstream from the arranged position of the transfer unit 31*d* in the main transport path 36. The register rollers 36*d* align the positioning of the toner image on the surface of the photosensitive drum 31*b* and the sheet for image formation while transporting the sheet for image formation. A fixing device 39, which is provided with a pair of fixing rollers 39*a* and 39*b* for fixing the transferred toner image to the sheet for image formation using heat is arranged downstream from the arranged position of the transfer unit 31*d* in the main transport path 36. Further still, a discharge roller 36*e* for discharging the sheets for image formation to the discharge tray 35 is arranged at the downstream end of the main transport path 36.

A branch catch 38 is arranged at a connection position on an upstream end of the reverse transport path 37 facing the main transport path 36. The branch catch 38 is configured to be freely rotatable around a horizontal axis between a first position shown by a solid line in FIG. 1, and a second position at which the reverse transport path 37 is released by rotating in a counterclockwise direction in the drawing from the first position. When the branch catch 38 is at the first position, the sheets for image formation are transported toward the discharge tray 35, and when it is at the second position, the sheets for image formation can be supplied to the reverse transport path 37. A transport roller 37*a* is arranged at the reverse transport path 37 and when a sheet for image formation is supplied to the reverse transport path 37 (when a sheet for image formation is supplied to the reverse transport path 37 by so-called switchback transport), the sheet for image formation is transported by the transport roller 37*a*, then the sheet for image formation is reversed on an upstream side of the register roller 36*d* such that it is again transported in the main transport path 36 toward the transfer unit 31*d*. That is, it is handled such that image formation can be carried out on the reverse side of the sheet for image formation.

The following is a description of the automatic original feeding portion 4. The automatic original feeding portion 4 is configured as a so-called reversing automatic document (original) feeder. The automatic original feeding portion 4 can be used as a sheet movement system and is provided with an original tray 43 as an original placement portion, an intermediate tray 44, an original discharge tray 45 as an original discharge portion, and an original transport system 46 that transports originals between the trays 43, 44, and 45.

The original transport system 46 is provided with a main transport path 47 for transporting originals placed on the original tray 43 to the intermediate tray 44 via the original capturing portion 42 or the original discharge tray 45, and a secondary transport path 48 for supplying originals on the intermediate tray 44 to the main transport path 47.

An original pickup roller 47*a* and a fielding roller 47*b* are arranged at an upstream end (a portion facing the discharge side of the original tray 43) of the main transport path 47. A fielding board 47*c* is arranged below the fielding roller 47*b* and, due to the rotation of the original pickup roller 47*a*, one sheet of the originals on the original tray 43 passes between the fielding roller 47*b* and the fielding board 47*c* such that it is supplied to the main transport path 47. PS rollers 47*e* are arranged on the downstream side of the linking area between the main transport path 47 and the secondary transport path 48 (area B in the drawing). The PS rollers 47*e* regulate the leading edge of the original and the image reading timing of the scanner portion 2 to supply originals to the original capturing portion 42. That is, the PS rollers 47*e* temporarily stop the transport of the original in the state in which the original was supplied, and regulates this timing to supply originals to the original capturing portion 42.

The original capturing portion 42 is provided with a platen glass 42*a* and an original pressing board 42*b* and, when an original supplied from the PS rollers 47*e* passes through between the platen glass 42*a* and the original pressing board 42*b*, light from the above-mentioned exposure light source 21 passes through the platen glass 42*a* and is irradiated on the original. At this juncture, original image data is obtained by the above-mentioned scanner portion 2. A biasing force is applied to the back surface (top surface) of the original pressing board 42*b* by an unshown coil spring. In this way, the original pressing board 42*b* makes contact against the platen glass 42*a* with a predetermined suppressing force, thus preventing the original from rising up from the platen glass 42*a* when the original passes through the original capturing portion 42.

Transport rollers 47*f* and original discharge rollers 47*g* are provided on a downstream side of the platen glass 42*a*. An original that passes over the platen glass 42*a* is discharged to the intermediate tray 44 or the original discharge tray 45 via the transport rollers 47*f* and the original discharge rollers 47*g*.

An intermediate tray undulation board 44*a* is arranged between the original discharge rollers 47*g* and the intermediate tray 44. The intermediate tray undulation board 44*a* has its center of undulation at an edge area of the intermediate tray 44 and is able to undulate between a position (hereinafter referred to as "position 1") shown in the drawing by a solid line and a position (hereinafter referred to as "position 2") that is raised upwards from the position 1. When the intermediate tray undulation board 44*a* is in the position 2, an original discharged from the original discharge rollers 47*g* is withdrawn to the original discharge tray 45. On the other hand, when the intermediate tray undulation board 44*a* is in the position 1, an original discharged from the original discharge rollers 47*g* is discharged to the intermediate tray 44. When an original is discharged to the intermediate tray 44, an edge of the original is put into a sandwiched condition between the original discharge rollers 47*g*, and by reversing the rotation of the original discharge rollers 47*g* while in this condition, the original is supplied to the secondary transport path 48 and is again dispatched to the main transport path 47 via the secondary transport path 48. The operation of reversing the rotation of the original discharge rollers 47*g* is carried out by regulating the dispatch of the original to the main transport path 47 and the timing of image reading. In this way, an image on the reverse side of an original can be read by the original capturing portion 42.

—Description of the Basic Operation of the Compound Machine—

As an operation of the compound machine 1 configured as described above, firstly, when the compound machine 1 functions as a printer, print data (image data, text data, etc) that is sent from a host device such as a personal computer is received and the received print data is temporarily stored in an unshown buffer (memory). Along with the storage of print data to the buffer, print data is read out from the buffer in order and, based on the print data that is read out, an image is formed on a sheet for image formation by an image forming operation of the above-described printing portion 3.

Furthermore, when the compound machine 1 functions as a scanner, the scanned image data of the original read by the above-described scanner portion 2 is temporarily stored in the buffer. Along with the storage of scanned image data to the buffer, the scanned image data is sent from the buffer to the host device in order, and an image is displayed on a display or the like of the host device.

Further still, when the compound machine 1 functions as a copying machine, an image is formed on a sheet for image formation by an image forming operation of the printing portion 3 based on the original image data that is read by the above-mentioned scanning function.

—Description of the Paper Discharge Mechanism—

Next, a paper discharge mechanism 7 is described as a recording medium discharge mechanism. The paper discharge mechanism 7 is provided with the above-mentioned discharge tray 35 and a side wall member 71 that is arranged at an end portion that is downstream in the paper discharge direction of the discharge tray 35.

The discharge tray 35 is provided with a paper placement surface 35*a* as a recording medium placement surface that is a slanted surface slanting slightly upwards toward the downstream side of the paper discharge direction. And the space above the paper placement surface 35*a* is a discharge space C for collecting sheets after image formation. That is, in the compound machine 1, the scanner portion 2 and the automatic original feeding portion 4 are arranged in an upper area, the paper cassette 33 is arranged in a lower area, and the printing portion 3 is arranged on the right side half in the drawing between the scanner portion 2 and the paper cassette 33, such that the compound machine 1 forms an approximate square-cornered reverse "C" shape when viewed from the front. Thus, the discharge space C is configured as an empty intermediate space that opens laterally (one side of the square-cornered reverse "C" shape (facing left in FIG. 1) is open), and paper (printed sheets) that are discharged to the discharge space C are taken out from the front side or a lateral side (the above-mentioned open side) of the compound machine 1.

It should be noted in regard to a specific dimension of the paper placement surface 35*a* of the discharge tray 35 that the length dimension of the paper placement surface 35*a* in the paper discharge direction (its dimension in the left to right direction in FIG. 1) is set shorter than the discharge direction length of the sheet having the largest discharge direction length of the plurality of types of sheets used in the compound machine 1 (for example shorter than A3 size when the compound machine uses B5, A4, B4, and A3 sheets).

The side wall member 71 is arranged at the open portion on the downstream side of the paper discharge direction. Specifically, as also shown in FIG. 2 (an outline structural view of the paper discharge mechanism 7 and the surroundings thereof, the side wall member 71 is provided at the downstream end portion of the discharge tray 35 in the paper discharge direction and is rotatably supported to rotate around a rotational axle extending in a horizontal direction perpendicular to the paper discharge direction (vertical direction in the paper plane of FIG. 1).

Furthermore, a coil spring 72 is arranged between the side wall member 71 and a side surface of the compound machine 1 such that the biasing force of the coil spring 72 is applied in a clockwise direction in the drawing with respect to the side wall member 71. It should be noted that the rotational position of the side wall member 71 in the clockwise direction is restrained to a position in which the side wall member 71 becomes upright as shown in FIG. 1. For example, by providing a stopper that restrains the rotational position of the side wall member 71 in the clockwise direction, or by making the lower end surface of the side wall member 71 abut the paper placement surface 35*a* of the discharge tray 35 as shown in FIG. 2, the clockwise rotation thereof is restrained.

Figure 2:
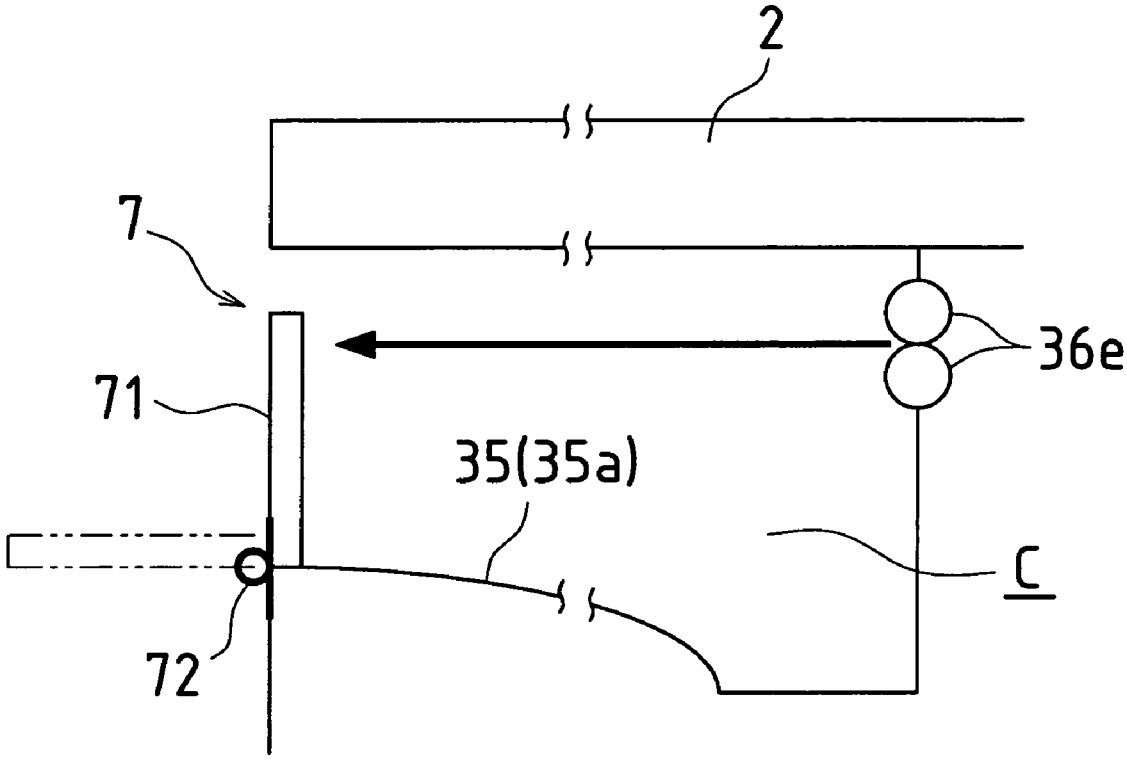
FIG. 2 shows an outline configuration of a paper discharge mechanism and a vicinity thereof.

Furthermore, the coil spring 72 that is employed has a comparatively small biasing force and when the side wall member 71 receives the external force from a sheet discharged to the discharge space C, the side wall member 71 resists the biasing force of the coil spring 72 and rotates easily in the counterclockwise direction shown in the drawing to become laid flat (the state of the provisional line in FIGS. 1 and 2). That is, in the event of a sheet being discharged to the discharge space C while the side wall member 71 is in an upright state, when the discharge speed of the sheet is greater than a predetermined speed or the hardness of the sheet is harder than a predetermined hardness, the side wall member 71 becomes laid flat due to the external force from the sheet, thereby opening the downstream side of the discharge tray 35 in the paper discharge direction and lengthening the paper placement surface 35*a* toward the downstream side in the paper discharge direction. It should be noted that the paper discharge speed or the paper hardness for making the side wall member 71 go into a laid flat state are determined by appropriately setting the biasing force of the above-mentioned coil spring 72.

Figure 3A:
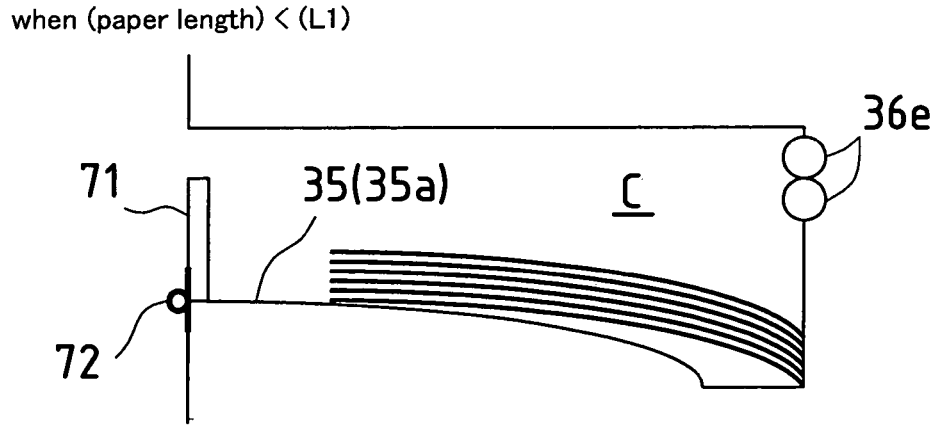
FIGS. 3A, 3B and 3C show states in which various sheets are discharged to a discharge space, with FIG. 3A showing a state in which sheets that have a discharge direction length shorter than the length of the paper placement surface have been discharged to the discharge space, FIG. 3B showing a state in which sheets that have a discharge direction length slightly longer than the length of the paper placement surface have been discharged to the discharge space, and FIG. 3C showing a state in which sheets, which have a discharge direction length longer than the length of the paper placement surface and have a maximum discharge direction length, have been discharged to the discharge space.

FIG. 3 show states in which various sheets are discharged to the discharge space C. FIG. 3A shows a state in which sheets (B5 size sheets for example) that have a discharge direction length shorter than the length of the paper placement surface 35*a* have been discharged to the discharge space C. In this case, the side wall member 71 maintains an upright state.

Figure 3B:
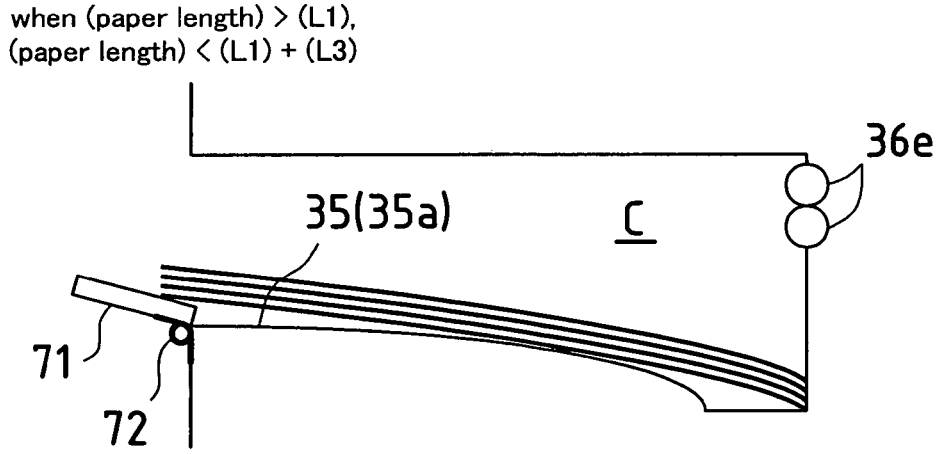

FIG. 3B shows a state in which sheets (B4 size sheets for example) that have a discharge direction length slightly longer than the length of the paper placement surface 35*a* have been discharged to the discharge space C. In this case, the side wall member 71 receives the external force from the sheets and becomes laid flat such that the sheets become placed extending from the paper placement surface 35*a* over the upper surface of the side wall member 71.

Figure 3C:
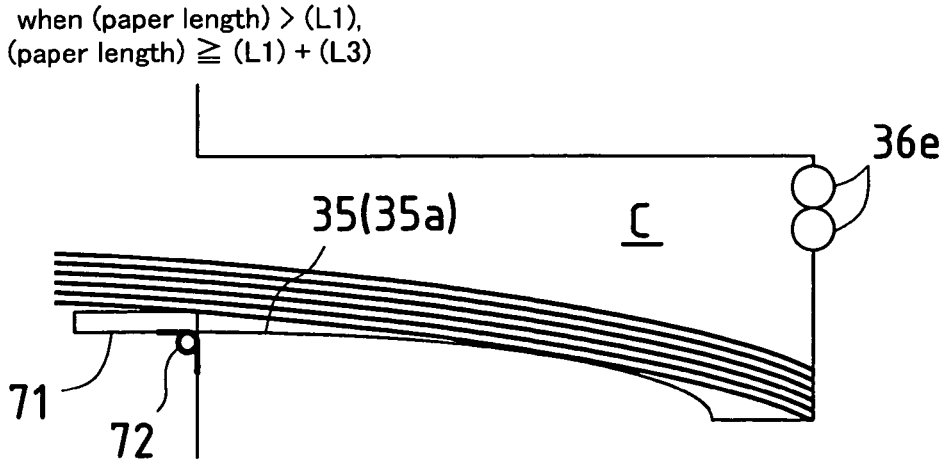

Further still, FIG. 3C shows a state in which sheets (A3 size sheets for example), which have a discharge direction length longer than the length of the paper placement surface 35*a* and have the maximum discharge direction length, have been discharged to the discharge space C. In this case too, the side wall member 71 receives the external force from the sheets and becomes laid flat such that the sheets become placed extending from the paper placement surface 35*a* over the upper surface of the side wall member 71. Furthermore, in this case, as will be described later, the position of the end portion of the sheets is a position that protrudes slightly further than the end position of the side wall member 71, which is a state in which a user can easily take out the sheets by gripping the end portion of the protruding sheets.

After the side wall member 71 has been laid flat in this way by sheets having been discharged to the discharge space C, due to the biasing force of the coil spring 72, the side wall member 71 again becomes upright and does not protrude once the sheets are removed from the discharge space C, thus contributing to compactness of the installation space of the compound machine 1.

The size of the side wall member 71 is described here. When a length dimension of the paper placement surface 35*a* of the discharge space C in the paper discharge direction is given as L1, a length dimension in the discharge direction of a sheet having the largest discharge direction length of the plurality of types of sheets used in the compound machine 1 is given as L2, and an extension length dimension toward a downstream side in the paper discharge direction when the side wall member 71 has been laid flat is given as L3, the size of the side wall member 71 is set such that the following is true:

$$L3 \leqq L2 - L1 \quad (1)$$

Due to this, when image formation is carried out on a sheet of the maximum discharge direction length, the side wall member 71 becomes laid flat, but the position of the end portion of the sheet at this time is a position protruding slightly further than the end position of the side wall member 71. Thus, a user is able to easily take out the sheet by gripping the end portion of the discharged sheet, which enables improved sheet withdrawal and obviates the side wall member 71 being made larger than necessary. Since the size of the side wall member 71 is set in this way, the size of the side wall member 71 does not have to be a size by which the entire open portion of the discharge space C is closed during the upright state. That is, a height that enables the sheets that are to be discharged to be caught is sufficient for the height for closing the open portion of the discharge space C.

Furthermore, an acrylic resin is employed specifically as a material for the above-described side wall member 71 and the entirety of the side wall member 71 is transparent or semi-transparent. Thus, outside light passes through the side wall member 71 to illuminate the interior of the discharge space C even when the side wall member 71 is in the upright state, which achieves improved visibility by the user for sheets that are discharged to the discharge space C even without using a special lighting apparatus and enables prevention of the user forgetting to take out the sheets.

Effect of the Embodiment

As described above, by providing the side wall member 71 at the downstream end portion on the discharge tray 35 in the paper discharge direction, the side wall member 71 maintains an upright state closing the above-described open portion when the discharge direction length of paper used in image formation is the same or shorter than the paper discharge direction length of the paper placement surface 35*a* of the discharge space C. This enables the paper that is discharged to the discharge space C to be caught by the side wall member 71 and the paper does not drop from the discharge space C. On the other hand, when the discharge direction length of paper used in image formation is longer than the paper discharge direction length of the paper placement surface 35*a* of the discharge space C, the side wall member 71 becomes laid flat such that the above-described open portion is opened and the paper placement surface 35*a*, which is a lower surface of the discharge space, extends toward the downstream side of the paper discharge direction. This enables long sheets to be placed extending from the paper placement surface 35*a* of the discharge space C over the upper surface of the side wall member 71, which makes it possible to avoid paper bending and paper jams inside the discharge space C and prevents the dropping of paper from the discharge space C.

By providing the side wall member 71 that is capable of moving between the upright state and the laid flat state as described above, the position of the edge of one end of the compound machine 1 may be set at the position of the side wall member 71 in the upright state, and large size sheets can be held without dropping even without extending this laterally from the position of the side wall member 71. Thus, it is possible to achieve compactness in the installation space of the compound machine 1. Furthermore, it is sufficient to provide only a mechanism for changing the position of the side wall member 71, and it is unnecessary to provide a mechanism for horizontally rotating the discharged paper collection means as is done conventionally or to carry out ON/OFF control of a lighting lamp, and therefore control operation can be simplified. In particular, with the structure of the present embodiment, the above-described switching operation can be realized without necessitating a special drive source for switching between the upright state and the laid flat state of the side wall member 71.

Modified Example

A modified example of the present invention is described next. This example is a modified example of the structure for changing the position of the side wall member 71. Since other portions of the configuration are the same as in the above-described embodiment, only the structure for changing the position of the side wall member 71 is described here.

Figure 4:
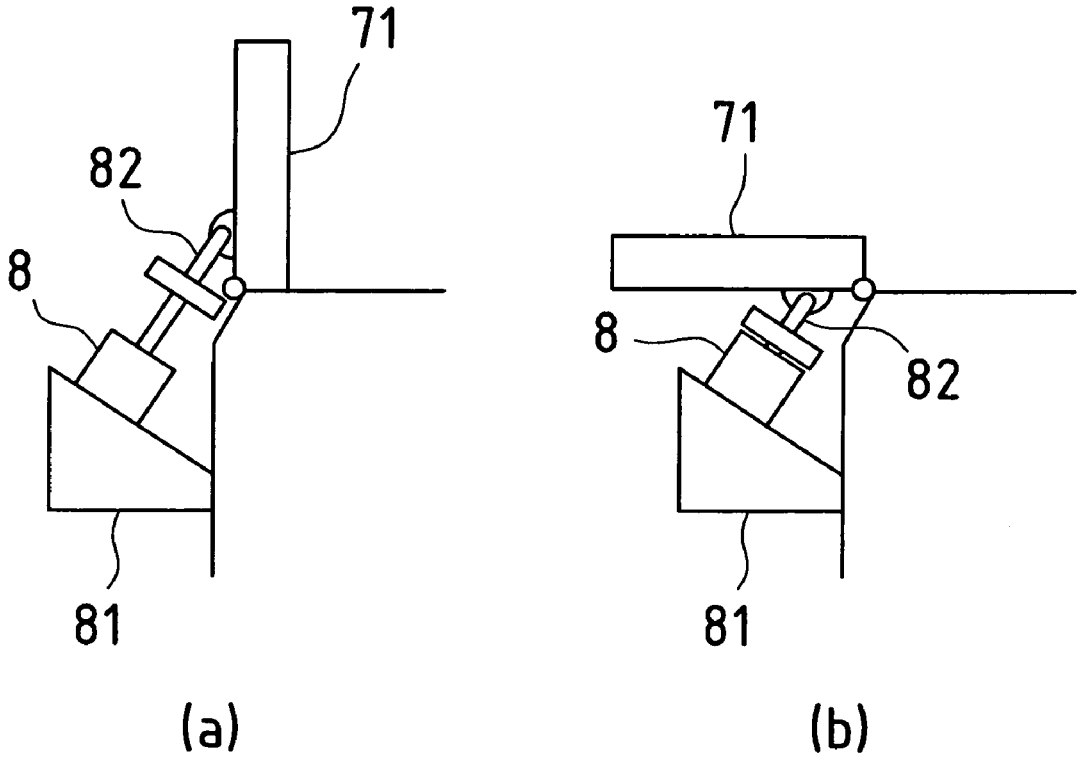
FIG. 4*a* and FIG. 4*b* are outline configurations showing the side wall member and a drive mechanism thereof in a modified example.

FIG. 4 is an outline structural view showing the side wall member 71 arranged at a downstream end portion of the discharge tray 35 in the paper discharge direction and a drive mechanism thereof. As shown in the drawing, the side wall member 71 according to the present embodiment is provided at the downstream end portion of the discharge tray 35 in the paper discharge direction and is rotatably supported to rotate around a rotational axle extending in a horizontal direction perpendicular to the paper discharge direction (direction perpendicular to the paper surface of FIG. 4).

A solenoid 8 is mounted on a side surface of the compound machine 1 via a mounting piece 81 as a drive mechanism for causing the side wall member 71 to rotate between the upright state and the laid flat state. A tip of a rod 82 that extends from the solenoid 8 is linked to the side wall member 71 so as to be relatively rotatable. Then, although the rod protrudes such that the side wall member 71 is kept in the upright state (see FIG. 4A) when the current is turned off for the solenoid 8, the rod 82 becomes inserted when the current is turned on for the solenoid 8 such that the side wall member 71 goes into the laid flat state (see FIG. 4B).

The operation for switching between times of current on and current off to the solenoid 8 is carried out corresponding to the type of paper to be used. That is, current to the solenoid 8 is turned on to make the rod 82 become inserted and thus make the side wall member 71 become laid flat only when the discharge direction length of the paper on which image formation is to be carried out in the printing portion 3 is longer than the length of the paper placement surface 35*a* of the discharge space C. Specifically, the side wall member 71 is put into the laid flat state prior to the operation of discharging the sheets. It should be noted that an operation for detecting the paper size may be by determining the paper size by paper size data in image information that has been obtained, or by providing an optical sensor on the paper carry path and identifying the paper size using this sensor.

Figure 5:
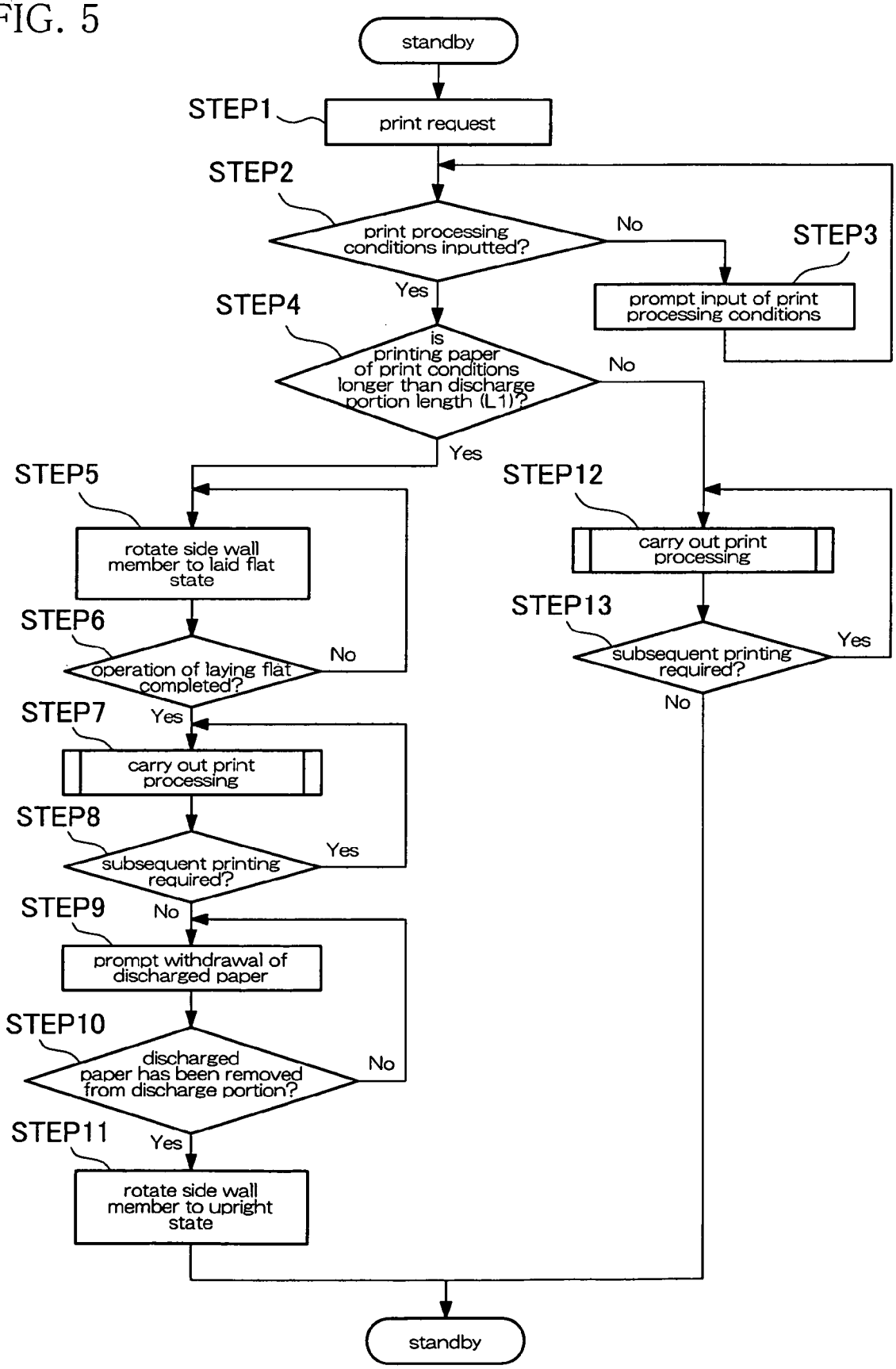
FIG. 5 is a flowchart showing a control operation procedure for changing the position of the side wall member in the modified example.

FIG. 5 is a flowchart showing a control operation procedure for changing the position of the side wall member 71 in the present example. The control operation is described below with reference to this flowchart.

First, in step 1, a request for printing is made to the compound machine 1 and step 2 involves waiting for print processing conditions to be inputted. If no print processing conditions are inputted, then a notifying operation is carried out in step 3 to prompt the user to input print processing conditions.

When print processing conditions are inputted ("yes" determination at step 2), then the procedure proceeds to step 4 and a determination is made as to whether or not the printing paper in the printing conditions is longer than the length of the discharge portion (the paper discharge direction length of the paper placement surface 35*a*). Then, if this determination is "yes," then a current to solenoid 8 is turned on causing the rod 82 to become inserted, which puts the side wall member 71 into the laid flat state (step 5). Then, when the rod 82 is fully inserted and the operation of laying flat the side wall member 71 is completed ("yes" determination at step 6), print processing is carried out (step 7) with respect to the paper.

After the executing of the print processing, image formation continues in order while determining whether or not subsequent printing is required and when image formation for all the image data has been completed, a notifying operation is carried out in step 9 prompting the user to take out the paper from the discharge tray 35.

Then, when the user takes out the paper from the discharge tray 35 ("yes" determination at step 10), the power to the solenoid 8 is terminated to make the rod 82 protrude, thereby putting the side wall member 71 into the upright state (step 11) and causing a "standby state" in which the compound machine waits for a subsequent printing request.

On the other hand, if the determination at step 4 is "no," that is, if the printing paper in the printing conditions is the same or shorter than the discharge length (paper discharge direction length of the paper placement surface 35*a*), then the current to the solenoid 8 is not turned on, that is, the side wall member 71 is maintained in an upright state and print processing is carried out on the paper (step 12). Then, after the executing of the print processing, image formation continues in order while determining whether or not subsequent printing is required and when image formation for all the image data has been completed ("no" determination at step 13), the compound machine is put into a "standby state" waiting for any subsequent printing.

As described above, with the structure of this example, it is possible to put the side wall member 71 into the appropriate position (upright state for small size papers and laid flat state for large size papers) prior to paper being discharged to the discharge space C at the time of an image formation operation, and when carrying out image formation on large size papers in particular, the end of the papers that are discharged can be kept from colliding with the side wall member 71 such that damage or the like of the end of the papers can be reliably avoided.

Other Embodiments

In the above-described embodiment and modified example, description was given as applied to a multifunction type image forming apparatus (compound machine) 1 provided with functions of a combination of a copying machine, a printer, and a facsimile machine. However, the embodiments are not limited to this and may be applied to an image forming apparatus provided with any one of these functions or a different image forming apparatus.

In the above-described embodiment and modified example, a gap was formed between the upper end of the side wall member 71 in the upright state and the lower end of the scanner portion 2, but the size of the side wall member 71 may be set so that no gap is formed between the upper end of the side wall member 71 and the lower end of the scanner portion 2, thereby improving the attractiveness of the apparatus.

Furthermore, in the above-described modified example, print processing was set to commence after the operation for laying flat the side wall member 71 was completed, but the print processing operation and the operation for laying flat the side wall member 71 may be carried out concurrently. That is, the operations may be controlled so that the operation for laying flat the side wall member 71 is completed prior to paper being discharged to the discharge space C.

INDUSTRIAL APPLICABILITY

The embodiments are effective in image forming apparatuses having a discharge portion for printed sheets in an empty intermediate space of a square-cornered reverse "C" shape. The embodiments contribute to reducing the installation space of image forming apparatuses by having a side wall member that does not protrude laterally from the apparatus, and is beneficial in that large size sheets can be loaded while avoiding paper bending and paper jams inside the discharge space in the laid flat state, thereby enabling compactness of installation space for image forming apparatuses, and since it is unnecessary to provide a mechanism for horizontally rotating the discharged paper collection means as is done conventionally or to carry out ON/OFF control of a lighting lamp, simplification of control operation can be achieved.

Furthermore, it is beneficial in that when a transparent member or a semitransparent member is used for the side wall member, outside light passes through the side wall member to illuminate the interior of the discharge space even when the side wall member is in the upright state, which achieves improved visibility of the recording media that are discharged to the discharge space even without using a special lighting apparatus, thereby improving the ease of use of an image forming apparatus.

The invention claimed is:

1. A recording medium discharge mechanism positioned between an original capturing portion arranged in a device upper portion and a feeding portion arranged in a device lower portion of an image forming apparatus, comprising:

a recording medium placement surface being a bottom surface of a discharge space, the discharge space having an open portion laterally to a downstream side in a recording medium discharge direction and receiving the recording medium that has undergone image formation in an image-forming portion of the image forming apparatus, wherein a discharge direction length of the recording medium placement surface is shorter than a length of a paper cassette of the feeding portion arranged to hold one or more types of recording media used in the image forming apparatus;

a side wall member being provided at the downstream end portion in the recording medium discharge direction of the recording medium placement surface, wherein the side wall member is rotatably supported to rotate around a rotational axle extending in a horizontal direction perpendicular to the recording medium discharge direction, and is capable of moving between an upright state that closes the open portion of the downstream side in the recording medium discharge direction in the discharge space and a laid flat state in which the placement surface for placing a discharged recording medium is extended toward the downstream side in the recording medium discharge direction; and a coil spring being provided between the side wall member and a side face of the image forming apparatus, the side face being located below the recording medium placement surface and continuing from the downstream end portion in the recording medium discharge direction of the recording medium placement surface, wherein the side wall member is arranged to receive a biasing force by the coil spring so as to rotate from the laid flat state to the upright state, and wherein the side wall member is configured to move from the upright state to the laid flat state against the biasing force by the coil spring only upon receiving an external force from the recording medium having a discharge speed greater than a predetermined speed or having a hardness greater than a predetermined hardness when the recording medium has been discharged to the discharge space in the upright state of the side wall member that closes the open portion, and the side wall member is also configured to move to the upright state with a lower end surface of the side wall member abutting on the recording medium placement surface due to the biasing force by the coil spring when the recording medium placed on the recording medium placement surface has been removed in the laid flat state of the side wall member.

2. The recording medium discharge mechanism according to claim 1, which is configured such that, when the discharge direction length of the recording medium placement surface of the discharge space is given as L1, the length of the paper cassette of the feeding portion arranged to hold one or more types of recording media used in the image forming apparatus is given as L2, and an extension length dimension toward a downstream side in the recording medium discharge direction when the side wall member has been put into the laid flat state is given as L3, $$L3 \leqq L2 - L1.$$

3. The recording medium discharge mechanism according to claim 1, wherein the side wall member is structured using a transparent member or a semitransparent member.

4. An image forming apparatus comprising the recording medium discharge mechanism according to claim 1, an original capturing portion arranged at an upper portion of the recording medium discharge mechanism, and a feeding portion arranged at a lower portion of the recording medium discharge mechanism.

5. The recording medium discharge mechanism according to claim 1, wherein the discharge space is formed interior to an image forming apparatus formed by the original capturing portion and the feeding portion.

6. The recording medium discharge mechanism according to claim 1, wherein the discharge space is separate from an original discharge space of the original capturing portion into which originally scanned documents are discharged after being scanned.

* * * * *